US012127630B2

(12) United States Patent
Heard, Sr.

(10) Patent No.: US 12,127,630 B2
(45) **Date of Patent: *Oct. 29, 2024**

(54) APPARATUS TO SECURE A PRIMARY BODY TO A SHOE

(71) Applicant: uninvited Inc., Berkeley, CA (US)

(72) Inventor: Airason John Heard, Sr., Berkeley, CA (US)

(73) Assignee: uninvited Inc., Berkeley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/479,572

(22) Filed: Oct. 2, 2023

(65) Prior Publication Data

US 2024/0023677 A1 Jan. 25, 2024

Related U.S. Application Data

(63) Continuation of application No. 17/828,753, filed on May 31, 2022, now Pat. No. 11,864,628, which is a continuation of application No. 17/085,646, filed on Oct. 30, 2020, now Pat. No. 11,388,953.

(51) Int. Cl.

| | |
|---|---|
| ***A43B 23/26*** | (2006.01) |
| ***A43C 11/08*** | (2006.01) |
| ***A43C 11/16*** | (2006.01) |

(52) U.S. Cl.

CPC ..... *A43B 23/26* (2013.01); *A43C 11/08* (2013.01); *A43C 11/16* (2013.01)

(58) Field of Classification Search

CPC ..... A43C 11/06; A43C 11/04; A43C 11/16; A43C 11/22; A43C 11/08; A43B 23/26; Y10T 24/53; Y10T 24/4594; Y10T 24/4502

See application file for complete search history.

(56) References Cited

U.S. PATENT DOCUMENTS

| | | | | | |
|---|---|---|---|---|---|
| 8,626 | A * | 1/1852 | Cook | A43C 11/22 | 24/575.1 |
| 260,852 | A * | 7/1882 | Dieter | A43C 11/16 | 16/17 |
| 488,090 | A * | 12/1892 | Rudge | A44B 11/266 | 24/694 |
| 609,918 | A * | 8/1898 | Steinberger | A41F 5/00 | 24/694 |
| 638,725 | A * | 12/1899 | Koontz et al. | A43C 11/16 | 24/619 |
| 658,342 | A * | 9/1900 | Christensen | A43B 23/26 | 36/54 |
| 773,719 | A * | 11/1904 | Dickson | A43B 23/26 | 24/619 |
| 1,162,663 | A * | 11/1915 | Stryffeler | A44B 17/0029 | 24/694 |
| 1,413,082 | A * | 4/1922 | Weinrich | F16B 5/02 | 24/694 |

(Continued)

*Primary Examiner* — Katharine G Kane

(74) *Attorney, Agent, or Firm* — Esplin & Associates, PC

(57) ABSTRACT

An apparatus is provided to secure a primary body to a shoe. Exemplary implementations may include an apparatus with one or more connectors to be engaged with one or more other connectors. The connectors of the apparatus may be engaged with the primary body eyelets and the shoelace eyelets in order to secure the primary body to the exterior side of the shoe.

10 Claims, 3 Drawing Sheets

(56) References Cited

U.S. PATENT DOCUMENTS 1,904,122 A * 4/1933 Chapman ..... A44B 17/0052 24/575.1
2,575,226 A * 11/1951 McHarry ..... A43C 11/22 36/51
3,822,489 A * 7/1974 Johnson ..... A43B 23/26 36/100
4,777,705 A * 10/1988 Ingram ..... A43D 999/00 24/575.1
5,214,826 A * 6/1993 Fortune ..... A43C 11/22 24/575.1
5,295,315 A * 3/1994 Osawa ..... A43C 11/22 24/712
5,526,585 A * 6/1996 Brown ..... A43C 11/22 36/52
6,497,003 B2 * 12/2002 Calabrese ..... B60N 3/046 296/97.23
7,945,992 B2 * 5/2011 Parisi ..... B60N 3/046 16/8
8,069,538 B2 * 12/2011 Wilcox ..... A43C 1/00 24/628
9,320,322 B1 * 4/2016 Castaneda ..... A43C 11/1493
10,492,567 B2 * 12/2019 Casas ..... A43C 11/22
11,096,448 B1 * 8/2021 Hodge ..... A43B 23/26
2002/0133979 A1 * 9/2002 Gantier ..... A43B 5/18 36/117.1
2002/0194712 A1 * 12/2002 Jackson ..... A43C 11/22 24/300
2003/0221334 A1 * 12/2003 McFee ..... A43C 11/22 36/1
2005/0257404 A1 * 11/2005 Daza ..... A43B 23/26 36/72 R
2008/0196224 A1 * 8/2008 Hu ..... A43C 11/165 24/68 SK
2009/0155015 A1 * 6/2009 Parisi ..... B60N 3/046 24/694
2009/0235485 A1 * 9/2009 Connor, Jr. ..... B60N 3/046 16/4
2010/0122429 A1 * 5/2010 Gonzalez ..... B23P 19/04 24/586.11
2011/0289743 A1 * 12/2011 Hill ..... A43C 11/22 24/713.6
2017/0332736 A1 * 11/2017 Casas ..... A43C 11/1493
2018/0084869 A1 * 3/2018 Raoufi ..... A43C 11/22
2018/0319617 A1 * 11/2018 Kim ..... A44B 11/125
2019/0142105 A1 * 5/2019 Boal ..... A43B 23/088 36/100
2019/0365052 A1 * 12/2019 Charles ..... A43C 11/08

* cited by examiner

APPARATUS TO SECURE A PRIMARY BODY TO A SHOE

FIELD OF DISCLOSURE

This disclosure relates to securing a primary body to the upper, external side of a shoe by engaging connectors of an apparatus. The apparatus engaging shoelace eyelets of the shoe and the eyelets of the primary body.

BACKGROUND

Shoelaces may be used to tighten or secure a shoe by being laced through the shoelace eyelets and tied at the base of the rows of shoelace eyelets

SUMMARY

This disclosure relates to securing a primary body to a shoe. An apparatus is disclosed that engages with the primary body and the shoe in order to secure the primary body to the exterior of the shoe. The apparatus may include one or more connectors, and/or other components. Responsive to the one or more connectors being engaged with one or more other connectors, the primary body is secured to the shoe. The shoe may include a sole, an upper body, and/or other components. The upper body of the shoe may include a tongue region and/or other components. The tongue region may include a first side flap, a second side flap, and/or other components. The first side flap may include a first set of shoelace eyelets and/or other components. The second side flap may include a second set of shoelace eyelets, and/or other components. The primary body may include one or more sets of eyelets, and/or other components. The apparatus may include an exterior connector, an intermediate connector, an interior connector, and/or other components.

The connectors of the apparatus may include male and/or female connecting elements, and/or other components, which may allow them to engage with other corresponding male and/or female connecting elements of other connectors of the apparatus. The connectors and/or parts of the connectors may be positions on the external and/or internal surfaces of the side flaps and/or primary body. The connectors and/or parts of the connectors may be positioned within the shoelace eyelets and/or primary body eyelets.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTIONS

Figure 1:
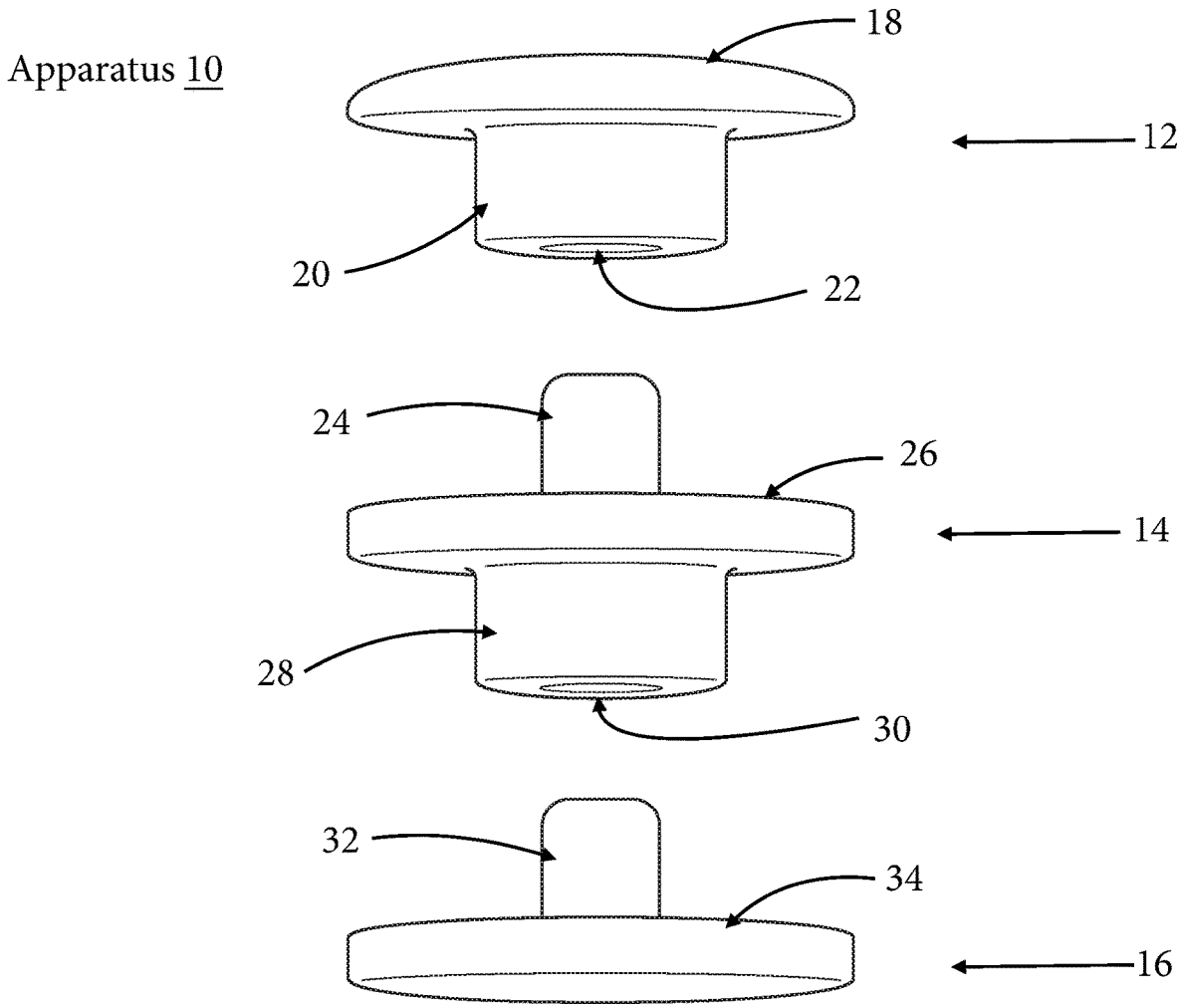
FIG. 1 illustrates the apparatus configured to secure a primary body to a shoe, in accordance with one or more implementations.

FIG. 1 illustrates an apparatus 10, in accordance with one or more implementations. The apparatus may be configured to secure a primary body to a shoe. Apparatus 10 may include one or more of an exterior connector 12, an intermediate connector 14, an interior connector 16, and/or other components. Exterior connector 12 may include an exterior lip 18, a protrusion 20, and/or other components. Protrusion 20 of exterior connector 12 may include a cavity 22 and/or other components. Intermediate connector 14 may include an exterior protrusion 24, an intermediate lip 26, an interior protrusion 28, and/or other components. Interior protrusion 28 of intermediate connector 14 may include a cavity 30 and/or other components. Interior connector 16 may include a protrusion 32, an interior lip 34, and/or other components.

Referring to FIG. 1, exterior lip 18 of exterior connector 12 may have a generally circular shape. In some implementations, exterior lip 18 may have a square shape, an oval shape, and/or other shapes. In some implementations, exterior lip 18 may have a dome-like shape, may have consistent thickness throughout, and/or may be formed in other ways. In some implementations, the diameter of exterior lip 18 is larger than the diameter of protrusion 20 and/or a primary body eyelet, such that when apparatus 10 is in the secured configuration, exterior lip 18 prevents exterior connector 12 from passing through the primary body eyelet.

Referring to FIG. 1, protrusion 20 may extend from exterior lip 18 and have a generally cylindrical shape. In some implementations, protrusion 20 may be of larger length and/or width. Protrusion 20 may include a proximal and distal end to exterior lip 18 and may include cavity 22. Cavity 22 may extend from an annular formation on the distal end of protrusion 20, and may extend into the protrusion, without extending to exterior lip 18. In some implementations cavity 22 may include a magnet component, a screw-like texture, and/or other formations. By way of non-limiting example, protrusion 20 and cavity 22 may comprise a female connecting element that may engage with a male connecting element.

Referring to FIG. 1, intermediate lip 26 of intermediate connector 14 may have a generally circular shape. In some implementations, intermediate lip 26 may have a square shape, an oval shape, and/or other shapes. In some implementations, the diameter of intermediate lip 26 is larger than the diameter of exterior protrusion 24 and interior protrusion 28. The diameter of intermediate lip 26 may also be larger than a primary body eyelet and/or a shoelace eyelet, such that when apparatus 10 is in the secured configuration intermediate lip 26 prevents intermediate connector 14 from passing through the primary body eyelet and/or the shoelace eyelet.

Referring to FIG. 1, exterior protrusion 24 may extend from intermediate lip 26 and have a generally cylindrical shape. In come implementations, exterior protrusion 24 may be of larger length and/or width. In some implementations exterior protrusion 24 may have a stud-like shape, a screw-like shape, and/or other shapes. By way of non-limiting example, exterior protrusion 24 may comprise a male connecting element that may engage with a female connecting element.

Referring to FIG. 1, interior protrusion 28 may extend from intermediate lip 26 and have a generally cylindrical shape. In some implementations, interior protrusion 28 may be of larger length and/or width. Interior protrusion 28 may include a proximal and distal end to intermediate lip 26 and may include cavity 30. Cavity 30 may extend from an annular formation on the distal end of interior protrusion 28, and may extend into protrusion 28, without extending to intermediate lip 26. In some implementations cavity 30 may include a magnet component, a screw-like texture, and/or other formations. By way of non-limiting example interior protrusion 28 and cavity 30 may comprise a female connecting element that may engage with a male connecting element.

Referring to FIG. 1, interior lip 34 of interior connector 16 may have a generally circular shape. In some implementations, interior lip 34 may have a square shape, an oval shape, and/or other shapes. In some implementations, the diameter of interior lip 34 is larger than the diameter of protrusion 32 and/or a shoelace eyelet, such that when apparatus 10 is in the secured configuration interior lip 24 prevents interior connector 16 from passing through the shoelace eyelet.

Referring to FIG. 1, protrusion 32 may extend from interior lip 34 and have a generally cylindrical shape. In come implementations, protrusion 32 may be of larger length and/or width. In some implementations exterior protrusion 32 may have a stud-like shape, a screw-like shape, and/or other shapes. By way of non-limiting example, protrusion 32 may comprise a male connecting element that may engage with a female connecting element.

Figure 2:
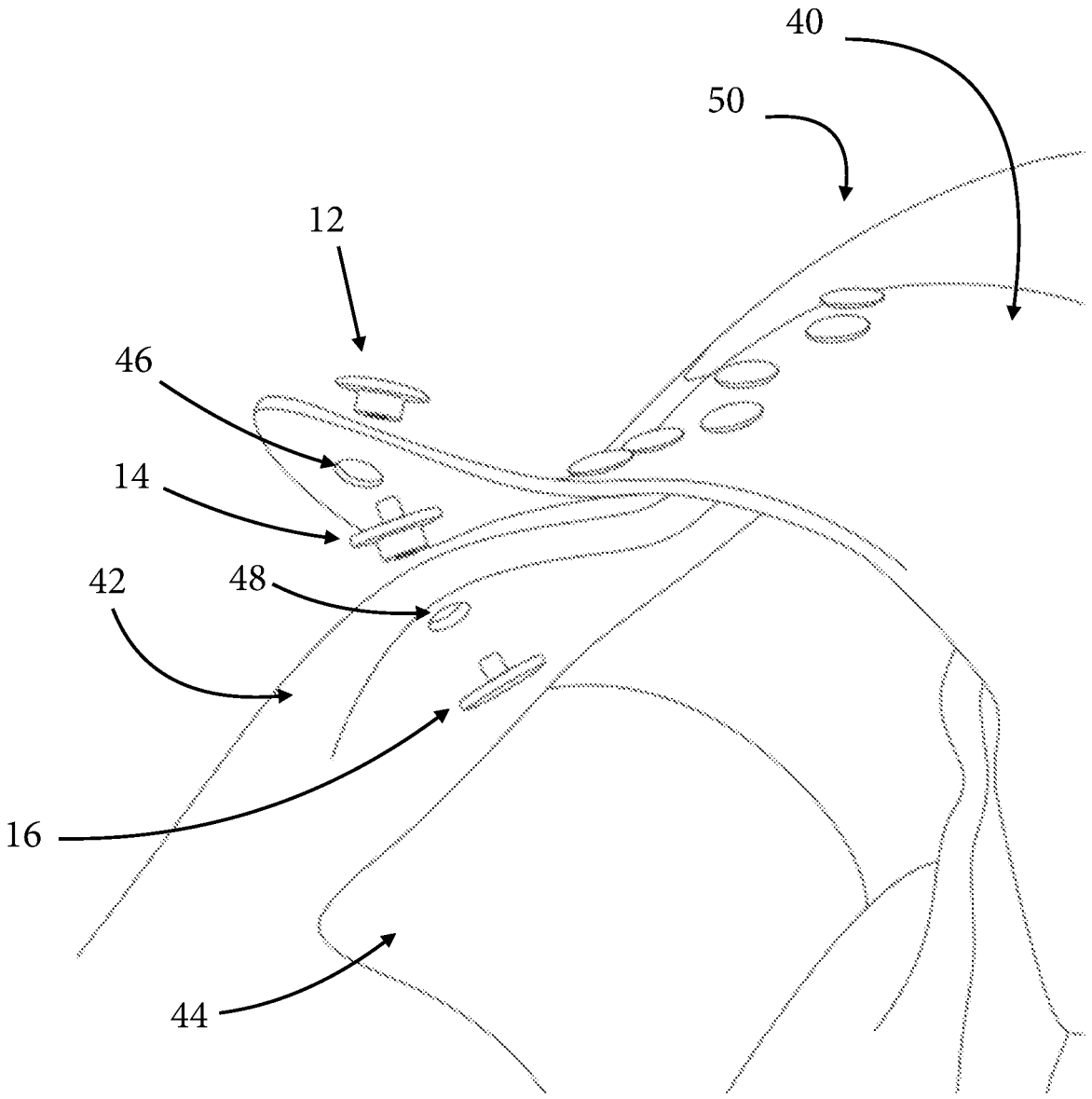
FIG. 2 illustrates the apparatus and its relative position to the primary body and shoe.

FIG. 2 illustrates the relative positions of components of apparatus 10, responsive to apparatus 10 being in the secured configuration and a primary body 40 is secured to a shoe 50. Primary body 40 may include one or more of a primary body eyelet 46, and/or other components. Shoe 50 may include one or more of a tongue region 44, a side flap 42, a shoelace eyelet 48, and/or other components.

It is noted that the terms "exterior" and "interior", may refer herein to the directions when considering the components of the shoe and primary body in a secured configuration of the apparatus. The "exterior" refers to the surface of primary body 40 and side flap 42 that is facing outward from the shoe 50. The "interior" refers to the surface of the primary body 40 and side flap 42 that is facing inwards toward the shoe.

Referring to FIG. 2, exterior lip 18 may be position on the exterior surface of primary body 40. By way of non-limiting example, exterior lip 18 may have a wider diameter than primary body eyelet 46, such that exterior lip 18 cannot be passed through primary body eyelet 46. In some implementations protrusion 20 may have a similar shape and/or size as and may be positioned inside primary body eyelet 46. Protrusion 20, responsive to apparatus 10 being in the secured configuration, may extend through primary body eyelet 46 and/or past primary body 40. By way of non-limiting example, the length of protrusion 20 may be longer than the thickness of primary body 40, such that protrusion 20 extents past primary body 40 and may contact the exterior surface of side flap 42.

Referring to FIG. 2, intermediate lip 26 may be positioned on the exterior surface of side flap 42. By way of non-limiting example, intermediate lip 26 may have a wider diameter than shoelace eyelet 48 and/or primary body eyelet 46, such that intermediate lip 26 cannot be passed through shoelace eyelet 48 and/or primary body eyelet 46. In some implementations interior protrusion 28 may have a similar shape and/or size as and may be positioned inside shoelace eyelet 48. Interior protrusion 28, responsive to apparatus 10 being in the secured configuration, may extend through shoelace eyelet 48 and/or past side flap 42. By way of non-limiting example, the length of interior protrusion 28 may be longer than the thickness of side flap 42, such that interior protrusion 28 extents past primary body 40 and contacts with tongue region 44.

Referring to FIG. 2, responsive to apparatus 10 being in the secured configuration, the female connecting elements of exterior connector 12 may engage with the male connecting elements of intermediate connector 14. By way of non-limiting example, the exterior protrusion 24 may have a similar shape and/or size as cavity 22, such that exterior protrusion may be inserted into cavity 22. In some implementations, exterior protrusion 24 may be inserted, pushed, and/or twisted into cavity 22, and/or other means of engagement. In some implementations, responsive to exterior connector 12 being secured to intermediate connector 14, protrusion 20 of exterior 12 may contact intermediate lip 26 of intermediate connector 14.

Referring to FIG. 2, responsive to exterior connector 12 being secured to intermediate connector 14, exterior lip 18 may prevent the apparatus from passing through the primary body eyelet 36 and intermediate lip 26 may prevent the apparatus from passing through the primary body eyelet 46 and/or shoelace eyelet 48. In some implementations, protrusion 20 may have exterior protrusion 24 engaged inside cavity 22 and may be positioned inside primary body eyelet 46.

Referring to FIG. 2, interior lip 34 may be positioned on the exterior surface of tongue region 44 and/or on the interior surface of side flap 42. By way of non-limiting example, interior lip 34 may have a wider diameter than shoelace eyelet 48, such that interior lip 34 cannot be passed through shoelace eyelet 48. Responsive to the apparatus being in the secured configuration, interior lip 34 may contact directly with the exterior surface of tongue region 44.

Referring to FIG. 2, responsive to apparatus 10 being in the secured configuration, the female connecting elements of intermediate connector 14 may engage with the male connecting elements of interior connector 16. By way of non-limiting example, the protrusion 32 may have a similar shape and/or size as cavity 30, such that protrusion 32 may be inserted into cavity 30. In some implementations, protrusion 32 may be inserted, pushed, and/or twisted into cavity 30, and/or other means of engagement. In some implementations, responsive to intermediate connector 14 being secured to interior connector 16, exterior protrusion 29 of intermediate connector 14 may contact interior lip 34 of interior connector 16.

Referring to FIG. 2, responsive to intermediate connector 14 being secured to interior connector 16, intermediate lip 26 and/or interior lip 34 may prevent the apparatus from passing through shoelace eyelet 48. In some implementations, interior protrusion 28 may have protrusion 32 engaged inside cavity 30 and may be positioned inside shoelace eyelet 48.

Referring to FIG. 2, responsive to the apparatus being in the secured configuration, user action may be need to separate exterior connector 12 from intermediate connecter 14 and/or intermediate connector 14 from interior connector 16.

Figure 3:
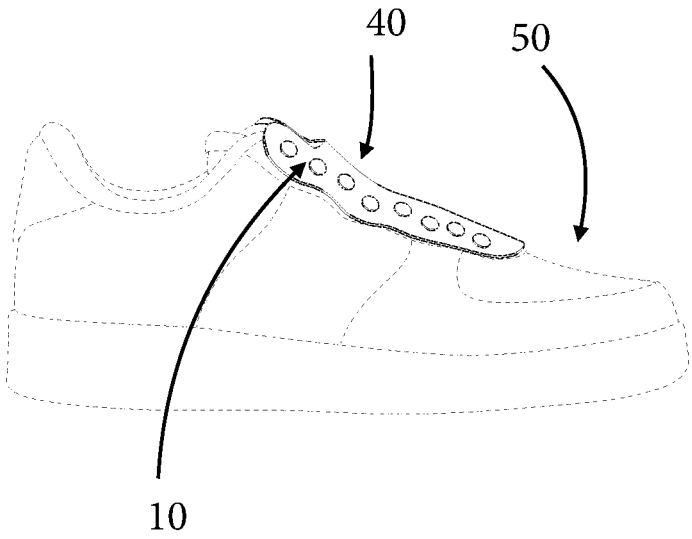
FIG. 3 illustrates a side view of a shoe with a primary body attached by multiple of the apparatus.

FIG. 3, illustrates a side view of shoe 50 with primary body 40 secured by multiple of apparatus 10. In some implementations, one or more of apparatus 10 may be secured in one or more of primary body eyelets and shoelace eyelets. In some implementations, responsive to one or more of apparatus 10 being in the secured configuration, exterior lip 18 is visible from a side view. By way of non-limiting example, one or more of apparatus 10 is shown with a generally circular exterior lip 18.

Figure 4:
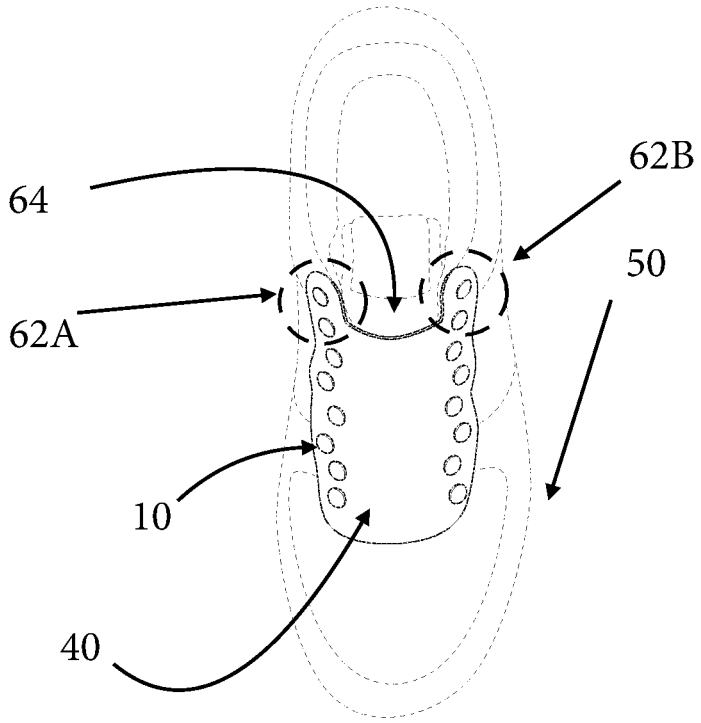
FIG. 4. illustrates a top-down view of the shoe with the primary body attached by multiple of the apparatus.

FIG. 4, illustrates a top-down view of shoe 50 with primary body 40 secured by multiple of apparatus 10. Primary body 10 may include one or more of a protrusion 62A and/or 62B. In some implementations, the primary body eyelets of primary body 40 may be aligned in a formation similar to the formation of the shoelace eyelets of shoe 50, such that primary body 50 may be placed on the exterior of shoe 50 and primary body eyelets are positioned on top of shoelace eyelets, creating multiple pairs consisting of one primary body eyelet and one shoelace eyelet. In some implementations, primary body 40 may be secured to shoe 50 by multiple of apparatus 10, each being in the secured configuration in each of the pairs of primary body eyelets and shoelace eyelets.

Referring to FIG. 4, in some implementations protrusion 62A and/or protrusion 62B may contain one or more of primary body eyelets. In some implementations, primary body 40 is secured to shoe 50 when one or more primary body eyelets is engaged with one or more shoelace eyelets by way of one or more of apparatus 10. Responsive to primary body 40 being secured to shoe 50, protrusion 62A and/or protrusion 62B may be positioned around the tongue region. Protrusion 62A and protrusion 62B may create a channel 64 of primary body 40. The tongue region of shoe 50 may extend past primary body 40 and be positioned in channel 64.

Although the present technology has been described in detail for the purpose of illustration based on what is currently considered to be the most practical and preferred implementations, it is to be understood that such detail is solely for that purpose and that the technology is not limited to the disclosed implementations, but, on the contrary is intended to cover modifications and equivalent arrangements that are within the spirit and scope of the appended claims. For example, it is to be understood that the present technology contemplated that, to the extent possible, one or more features of any implementation can be combined with one or more features of any other implementations.

The invention claimed is:

1. An apparatus configured to secure a shoe, the shoe having a sole, and an upper body, including a tongue region with two or more shoe flaps, wherein each shoe flap includes an interior side, an exterior side, and one or more shoelace eyelets:

an exterior connector including a first protrusion, wherein the exterior connector is coupled with a primary body, and wherein the first protrusion is configured to extend from an interior side of the primary body, the first protrusion being configured to couple with another protrusion, an intermediate connector including an intermediate plane, a second exterior protrusion, and a third interior protrusion, wherein the intermediate plane is configured to sit on the exterior side of a shoe flap and above the shoelace eyelet on the shoe flap, wherein the second exterior protrusion extends from the intermediate plane in the exterior direction to couple with the first protrusion, the third interior protrusion is configured to extend from the intermediate plane in the interior direction towards the shoe flap to couple with another protrusion and sit in the shoelace eyelet, an interior connector including an interior plane and a fourth protrusion, wherein the interior plane is configured to sit on the interior side of the shoe flap and directly below the shoelace eyelet on the shoe flap, the fourth protrusion extending from the interior plane in the exterior direction towards the shoe flap to couple with the third interior protrusion, and wherein, responsive to the second exterior protrusion of the intermediate connector being coupled with the first protrusion of the exterior connector, and the fourth protrusion of the interior connector being coupled with the third interior protrusion of the intermediate connector, the primary body is secure to the shoe and the connectors are in a secured configuration.

2. The apparatus of claim 1, wherein the first protrusion includes a proximal and distal end to the primary body, wherein an internal cavity is formed of the distal end of the first protrusion, wherein the second exterior protrusion of the intermediate connector forms a shape similar to the shape of the internal cavity of the first protrusion of the exterior connector, such that the second exterior protrusion is inserted into the internal cavity of the first protrusion.

3. The apparatus of claim 1, wherein the exterior connector is coupled with the protrusion of the intermediate connector by one or more of a screw-like mechanism, a snapping mechanism, a button mechanism, or a magnet mechanism.

4. The apparatus of claim 1, wherein the third protrusion includes a proximal and distal end to the intermediate plane, wherein an internal cavity is formed of the distal end of the third protrusion, wherein the fourth protrusion of the interior connector forms a shape similar to the shape of the internal cavity of the third protrusion of the intermediate connector, and the fourth protrusion is inserted into the internal cavity of the third protrusion.

5. The apparatus of claim 1, wherein the third protrusion of the intermediate connector is coupled with the fourth protrusion of the interior connector by one or more of a screw-like mechanism, a snapping mechanism, a button mechanism, or a magnet mechanism.

6. The apparatus of claim 1, wherein the shape of the first protrusion of the exterior connector is cylindrical and similar in diameter to the eyelets on the primary body, such that the first protrusion fits in the eyelet.

7. The apparatus of claim 1, wherein the shape of the third interior protrusion of the intermediate connector is cylindrical and similar in diameter to the shoelace eyelets on the side flaps, such that the third interior protrusion fits in the shoelace eyelet.

8. The apparatus of claim 1, wherein the intermediate plane encompasses the intermediate connector, and wherein the interior plane encompasses the interior connector.

9. The apparatus of claim 1, wherein the intermediate plane of the intermediate connector has a diameter that is similar or larger than the diameter of the shoelace eyelet of the shoe flap, such that the intermediate plane is prevented from passing through the shoelace eyelet.

10. The apparatus of claim 1, wherein the interior plane of the interior connector has a diameter similar or larger than the diameter of the shoelace eyelet of the shoe flap, such that the interior plane is prevented from passing through the shoelace eyelet.

* * * * *